US005175768A

United States Patent [19]

Daniels

[11] Patent Number: 5,175,768

[45] Date of Patent: Dec. 29, 1992

[54] METHOD AND APPARATUS FOR ENHANCING THE STEREO EFFECT IN HEADSETS HAVING CROSS COUPLING VOICE COILS

[76] Inventor: Joseph Daniels, 339 Waterside Rd., Northport, N.Y. 11768

[21] Appl. No.: 476,529

[22] Filed: Feb. 7, 1990

[51] Int. Cl.[5] ..... H04R 5/02
[52] U.S. Cl. ..... 381/25; 381/74
[58] Field of Search ..... 381/1, 24, 25, 74

[56] References Cited

U.S. PATENT DOCUMENTS 3,892,624 7/1975 Shimada ..... 381/24
4,586,192 4/1986 Arntson ..... 381/24

OTHER PUBLICATIONS

Soar, R. N. "Stereo Headphone Blender," *Practical Wireless* Jul. 1978 vol. 54, No. 3, p. 55.

*Primary Examiner*—Forester W. Isen
*Assistant Examiner*—Sylvia Chen
*Attorney, Agent, or Firm*—Ostrolenk, Faber, Gerb & Soffen

[57] ABSTRACT

Apparatus for providing cross coupling of information on two channels in a two channel transducer. The apparatus preferably comprises a first housing having a first transducer adapted to convert an electrical signal on a first of the channels to sound, a second housing having a second transducer adapted to convert an electrical signal on a second of the channels to sound, the first transducer comprising a first voice coil and the first housing having a further first voice coil, the second transducer comprising a second voice coil and said second housing further having a further second voice coil, the first voice coil being electrically coupled to the further second voice coil and the second voice coil being electrically coupled to the further first voice coil. In the embodiments, the sound pressure signals from the further first voice coil is less than that from the first voice coil and is effectively acoustically substracted therefrom, and the sound pressure signal from the further second voice coil is less than that from the second voice coil and is effectively acoustically substracted therefrom, resulting in the desired cross coupling.

25 Claims, 4 Drawing Sheets

METHOD AND APPARATUS FOR ENHANCING THE STEREO EFFECT IN HEADSETS HAVING CROSS COUPLING VOICE COILS

BACKGROUND OF THE INVENTION

1. Field of the Invention

This invention relates to the field of enhancing stereophonic sound reproduction by cross coupling.

2. Description of the Prior Art

The requisite of a stereophonic system is that its sound field must provide the listener with an illusion of spatial dimension giving both a sense of depth and location to the instrument(s) creating it.

In order to create such an illusion, the system must have a minimum of two transducers driven by separate but related signals. When the transducers are loudspeakers, effective operation requires their separation by a distance of 14 at least several feet. This allows the sound from the loudspeakers to be sufficiently spread out so as to be shared by both ears.

This sharing is termed acoustic cross coupling. Not only is it a natural result of the stereo loudspeaker listening experience, it is an essential element.

Unfortunately, acoustic coupling is denied the headphone listener because the sound at each ear is restricted to its own transducer's output. The resultant sound field lacks depth, and instead it is compressed and wedged into the central upper portion of the head.

Conventional stereo system information is composed of two signals, one left and one right channel respectively. Recording these signals using only left and right microphones rarely yields a commercially acceptable product. Further processing is usually required. This consists of adding signal enhancements that simulate the acoustic effects of reverberation and cross coupling.

Reverberation is the term given to the modification of a sound by its own reflections. These come from the surfaces forming the enclosed space in which the sound originates. It differs from an echo by having no discernable time delay between original and reflected sounds. They thus appear to be one.

It is simulated by splitting the signal into two parts. One part passes through a network whose output is delayed in real time. The delayed signal is then frequency contoured and added to the other part of the original signal.

Cross coupling simulation (hereinafter termed cross coupling), is a process previously exclusive to the commercial recording establishment. It is now available to the home listener notably in equipment made by Carver, see, e.g., U.S. Pat. Nos. 4,603,429, 4,309,570 and 4,218,585.

A cross coupled signal is formed by combining a channel's original signal with a fractional part of the signal from its opposite channel. The divisor creating a signal's fractional part is designated as K. This is done simultaneously in both channels.

Here is an example. A two channel stereo system of left signal amplitude L, would be changed to a new signal $L-R/K$. The term $R/K$ is of course, the fractional part of the system's right signal. The new right signal correspondingly becomes $R-L/K$.

No presently available system can fully compensate for the effects caused by a lack of acoustic cross coupling. It has been demonstrated however that cross coupled signals are of aid in headphone listening. Most listeners report a marked sense of spatial expansion to the resultant sound field.

There are basically two known ways of doing this.

In the first method, the signals are altered in the amplifier itself prior to going out to the headset. This is so simple and inexpensive to implement that its lack of use defies explanation.

An amplifier is set at unity gain by means of a resistor ra which connects its output to its inverting input. A signal R applied to the inverting input through a series resistor rb, would appear in the output essentially as $-R$ times the quantity $ra/ra+rb$. (The minus sign results from the use of the inverting input). A signal L applied to the non inverting input would be neither attenuated nor inverted and would therefor be output as L. If both of these signal inputs were concurrently applied, the output would be $L-R(ra/ra+rb)$. By proper design, the quantity $(ra/ra+rb)$ could be used to fractionate R in the same manner as the cross coupling constant K. The amplifier's output could then be the desired cross coupled signal of one channel. Two such circuits would be required for stereo.

A second method of producing cross coupling is to modify the signals at the headset itself. It must first be noted, however, that the patent art does shows some means for achieving acoustic cross coupling in headphones. Most notable is the method proposed in U.S. Pat. No. 4,173,715 to Gosman. He splits each transducer's acoustic output into two parts. One goes directly to the ear at which its transducer resides, and the other portion is fed by a duct to the opposite ear. Through a mechanical design, Gossman allows the ducted sound from one transducer to be mixed with sound from the transducer at that ear. Further, his design avoids the gross bulk that one would perceive as characterizing such a device. Its major disadvantage is its low acoustic cross coupling efficiency. This results in a diminished stereo effect, almost a subliminal quality.

A signal processing method assigned to Koss Corp., and disclosed in U.S. Pat. No. 3,924,072, places resistors in shunt with the audio input as well as resistance in series with the return lead of each transducer. In order to achieve a channel signal to fractional opposite signal ratio of about two to one, the network must dissipate as useless heat, approximately 90 percent of the applied audio power. In a market sustained almost solely by use with portable battery 14 operated amplifiers, such audio power waste translates into rapid battery use, and thereby into a marketing disaster. See also U.S. Pat. No. 3,984,636.

Accordingly, a more cost effective, less power consuming method and apparatus for achieving cross coupling in stereo headphones is needed.

SUMMARY OF THE INVENTION

It is a primary object of this invention to provide effective simulated acoustic cross coupling in stereo headphones that is both economical to produce and to use.

A further object of this invention to provide an effective and economical means for controlling the frequency content of this cross coupled signal.

Another object of the invention is to provide a simple and economical means for switching from cross coupled to conventional operation.

An additional object of the invention is provide the aforesaid advantages from transducers having low voice coil impedances of but a few ohms. High audio output levels may thus be efficiently obtained from amplifiers operating with such low supply voltages as though available from one to just a few battery cells.

A further object of this invention is to permit the aforesaid headset benefits to be amplifier independent, and to work optionally with any audio systems that use a conventional three wire jack at its stereo output.

The above and other objects of the invention are achieved by apparatus for providing cross coupling of information on two channels in a two channel transducer comprising a first housing having a first transducer adapted to convert an electrical signal on a first of the channels to sound, a second housing having a second transducer adapted to convert an electrical signal on a second of the channels to sound, the first transducer comprising a first transducer element and the first housing having a further first transducer element, the second transducer comprising a second transducer element and the second housing having a further second transducer element, the first transducer element being electrically coupled to the further second transducer element and the second transducer element being electrically coupled to the further first transducer element.

To explain the invention, the sound output of a transducer of the dynamic type is proportional to the quantity Bli, where, B is the flux density in its magnetic gap, l is the effective length of the conductor (voice coil) in the gap, and i is the current flowing through the conductor.

Consider a pair of headset transducers each of which has two voice coils accessible through four independent leads. Connect one voice coil on each transducer so that it is in series with a voice coil on the other transducer.

The sound field of each transducer may therefore be considered as consisting of two pressure components. One produced by the current flowing from its designated signal channel (left or right), and the other produced by the current from its opposite channel.

Since all coil leads are separate, we can by suitable connections, cause the sound pressure from the opposite channel current, to subtract from the sound pressure of the channel itself. Further, in a given transducer, any desired ratio between the pressures produced by a transducer's signal channel coil and its subtracting coil may be established solely through their turns ratio since they share the same magnetic structure.

This is another way of saying that the effect of the subtractive magnetic fields of the transducer's two voice coils is to produce a subtracted (reduced) sound pressure. The resultant sound pressures, by either explanation, would be exactly the same, and the concepts may therefore be used interchangeably. The concept of a sound field consisting of two subtractive pressure components or of a sound field produced by two subtractive magnetic voice coil components, are alternative ways of viewing the results achieved by the invention and are used interchangeably, in this disclosure, since they both produce the same resultant sound pressure in a given transducer.

The combined coil impedances (signal plus subtracting coils) may be readily designed to obtain maximum power from battery operated amplifiers. High efficiency is therefore an important feature of the method and apparatus of the invention and this places it in sharp contrast to other methods.

BRIEF DESCRIPTION OF THE DRAWINGS

These and other objects and many of the attendant advantages of this invention will be readily appreciated as the same become better understood by reference to the following detailed description and when considered in connection with the accompanying drawings in which.

DETAILED DESCRIPTION OF PREFERRED EMBODIMENTS

Figure 1C:
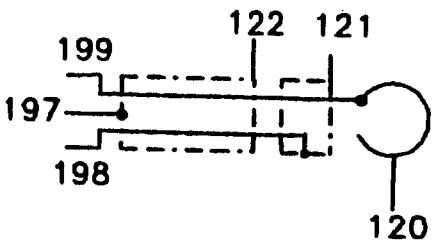
FIG. 1*c* shows the diagram of a three-lead stereo connecting plug.
Figure 1B:
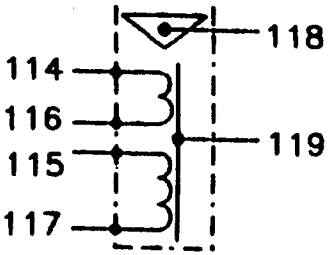
FIG. 1*b* shows the schematic diagram of a transducer according to the invention.
Figure 1A:
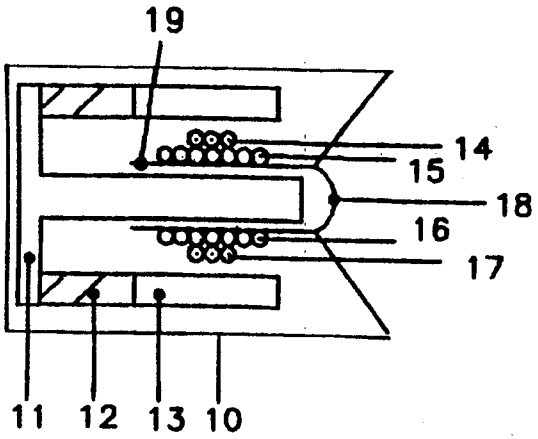
FIG. 1*a* shows a cross section of a transducer having two voice coils.

With reference now to the drawings, in FIG. 1*a* a cross sectional view of an applicable transducer comprising one transducer of a headset is shown as being comprised of elements numbering 10 through 19 inclusive.

Outside case 10 encloses all of the transducer elements. Part 11 is the bottom plate and pole piece of the magnetic circuit and 12 is its magnet, 13 its top plate. Coil 14–17 is smaller than the inner coil 15–16. Both reside on voice coil form 19 to which diaphragm 18 is attached.

Clarity of disclosure and function may be considerably enhanced by not repeatedly reproducing the mechanical aspects of the transducer, (case, magnet etc.) in succeeding drawings. They would only serve to clutter them up since such details are actually extraneous to further exposition of the circuits and functions of this invention.

Accordingly, a simplified electrical schematic circuit, FIG. 1*b*, has been developed that will henceforth be used to represent a transducer throughout the remaining figures.

The transducer has two separate voice coils, 114–116 and 115–117 respectively. Coil 114–116 is shown as the smaller of the two and therefore would represent the subtracting signal winding. Both share voice coil form 119 which drives diaphragm 118.

The amplifier connecting parts of a three lead phono plug are also shown in FIG 1*c*. The long section 122 is common to both channels and lead 197 brings it to both transducers of the headset. Middle section 121 may be the right channel and goes to the right transducer via lead 198. The end ball 120 may be the left channel and its lead 199 feeds the left transducer.

Figure 2:
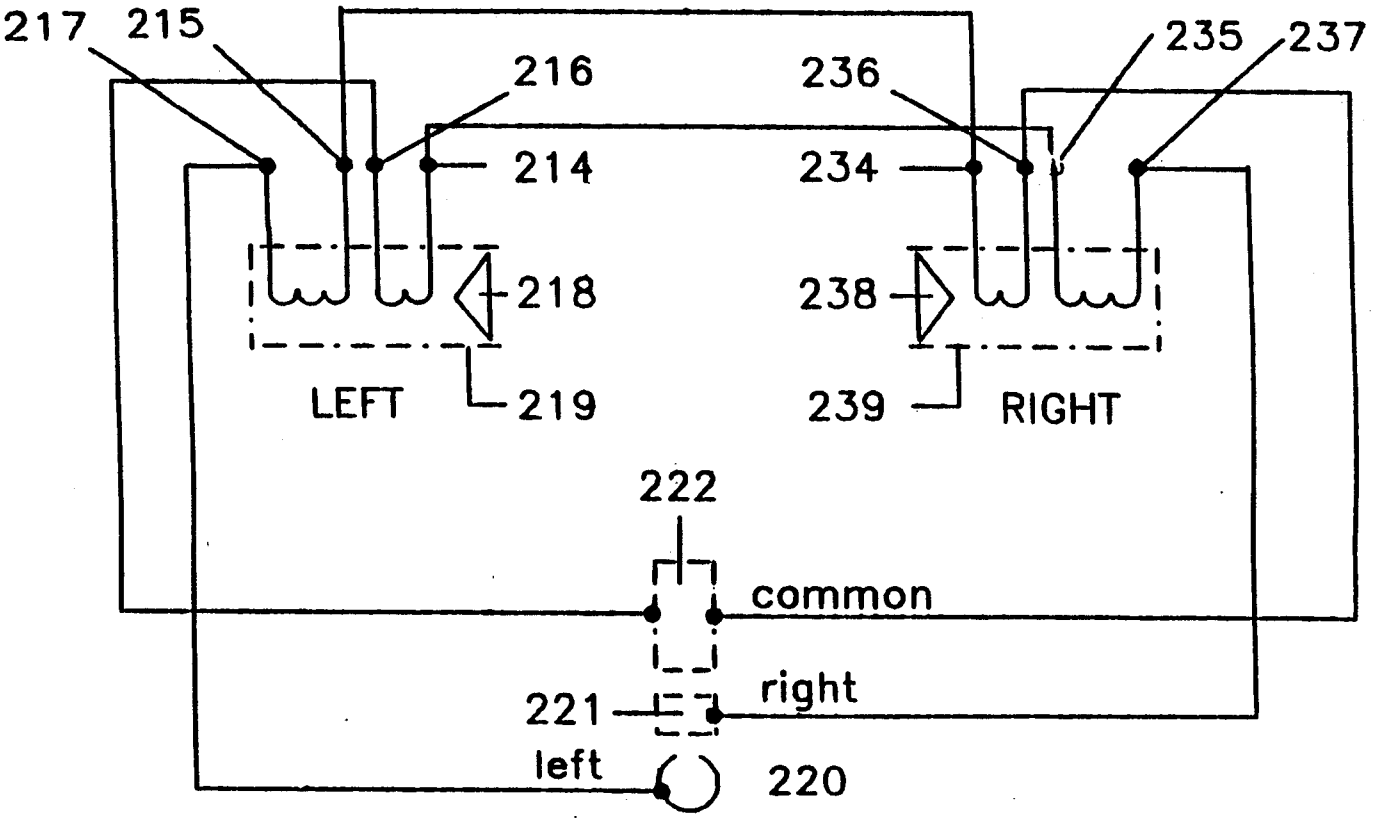
FIG. 2 shows the basic cross coupling circuit according to the invention.

In FIG. 2 it is a given that the left transducer and right transducer are identical in all physical, electrical and operational respects.

The left signal is introduced at plug segment 220 and connects to the main voice coil of the left transducer at 217. The return of this coil 215 connects to the small coil of the right transducer at 234. The remaining lead of this coil 236 returns the signal to phono plug common 222.

The right signal is introduced at plug segment 221 and connects to the main voice coil of the right transducer at 237. The return of this coil 235 connects to the small coil of the left transducer at 214. The remaining lead of this coil 216 returns the signal to phono plug common 222.

Note the current paths. The left current starts its flow first at the large coil 217–215 and flows through the right transducer's smaller coil 234–236 and then flows to the common return in the opposite direction to the current flowing through the right transducer's larger coil 237–235.

The right channel's sound pressure R, results from its signal current flowing through its larger coil by coil 237–235. The current flowing in the opposite direction through coil 234–236 creates a sound pressure, −L. Note this pressure's negative sign.

This latter pressure must be but a fractional portion of the right signal transducer's full sound. This is assured by winding coil 237–235 with more turns than coil 234–236 and by setting their turns ratio equal to K, which in turn is the ratio between a channels signal and its fractional subtracting part.

Thus a winding ratio of K would result in an overall pressure equal to R−L/K, which is the sum of the right channel's signal sound pressure R and the fractional left signal sound pressure, −L/K.

In a similar fashion, the left transducer sound pressure L created by the current flowing through coil 217–215 shares a negative pressure −R/K created by coil 214–216. The resultant sound pressure is of course, L−R/K.

Figure 3:
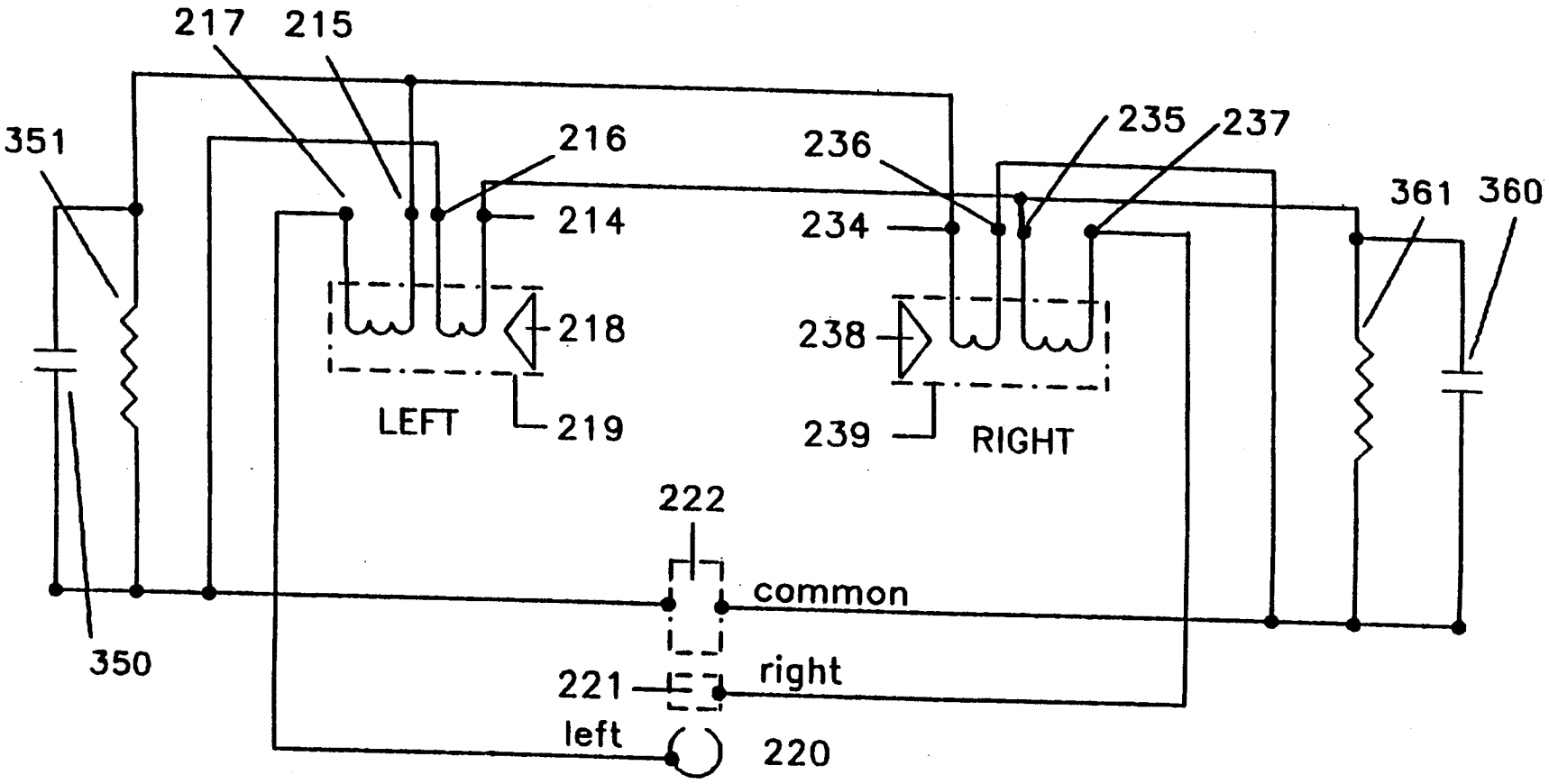
FIG. 3 shows added means for frequency modification.

In FIG. 3 the left transducer and right transducer are also given as being identical in all physical and electrical and operational respects to those shown and described in FIG. 2 and accordingly shares the parts numbered 214 through 239 inclusive.

It may be useful to curtail the upper frequency range over which the cross coupling is effective. A low pass filter could readily accomplish this. Capacitor 350 forms such a low pass filter in conjunction with inductance 217/215 as its signal series element. The cross over frequency is defined as the point at which their reactances are equal.

Resistor 351 limits the effect of the reactance of coil 234/236 which would otherwise continue to rise with frequency.

Capacitor 360, right channel large coil 237/235 and resistor 361 are connected in low pass configuration and function in exactly the same fashion as their left channel counterparts 350 and 351 and coil 216–214 which would otherwise continue to rise with frequency.

Figure 4:
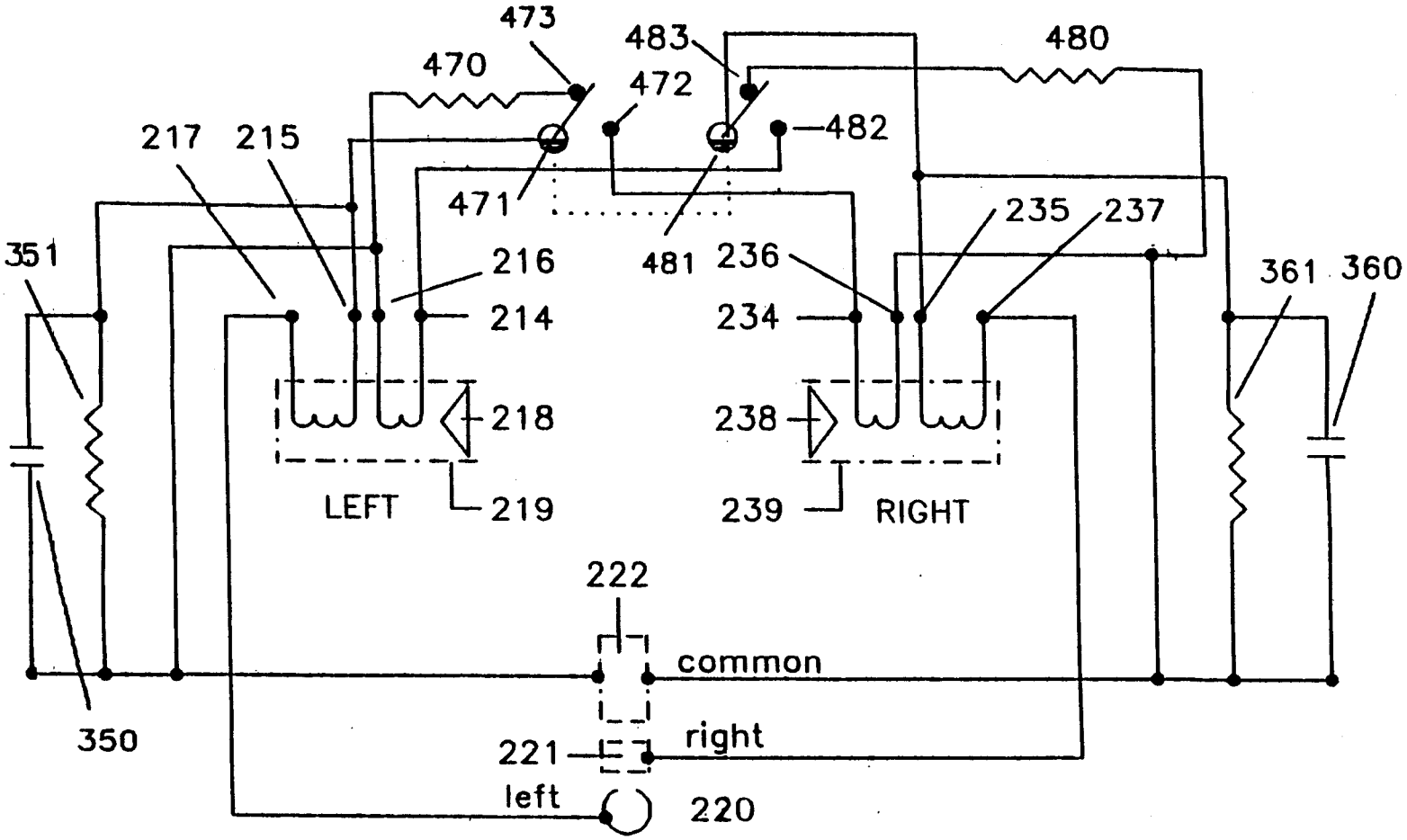
FIG. 4 shows added means for disconnecting cross coupling.

In FIG. 4 the left transducer and right transducer are also given as being identical in all physical and electrical and operational respects to those shown and described in FIG. 3 and accordingly share parts numbered 214 through 239 inclusive as well as optionally parts 350 through 361 inclusive.

Switch arms 471 and 481 are mechanically but not electrically ganged. When arm 471 is at 473, the current path for the signal at 220 is directly through coil 217/215 and returns to the plug common 222 through optional resistor 470. This is the switch position at which cross coupling processing is shut off. If resistor 470 is used at all, its value is so chosen as to equalize the sound levels at which either of the options are perceived.

When arm 481 is at 483, the current path for the signal at 221 is directly through coil 237/235 and returns to the plug common 222 through optional resistor 480. This is the switch position at which cross coupling processing is shut off. If resistor 480 is used at all, its value is so chosen as to equalize the sound levels at which either of the options are perceived.

When switch arms 471 and 481 are connected to pole 472 and 482 respectively, cross coupling as described above with reference to FIG. 3 is provided.

It should be understood that the foregoing relates only to preferred embodiments of the invention which have been by way of example only, and that it is intended to cover all changes and modifications of the examples herein chosen for the purposes of this disclosure, which do not constitute departures from the spirit and scope of this invention.

What is claimed is:

1. Apparatus for providing cross coupling of information to two channels in a two-channel transducer, the two channel transducer being a stereo headphone, the apparatus comprising:

a first housing having a first transducer adapted to convert an electrical signal on a first of said channels to sound; and a second housing having a second transducer adapted to convert an electrical signal on a second of said channels to sound;

said first transducer comprising a first transducer element having a first voice coil and said first housing including a further first transducer element having a further first voice coil, said second transducer comprising a second transducer element having a second voice coil and said second housing including a further second transducer element including a further second voice coil, said first transducer element being electrically coupled to said further second transducer element and said second transducer element being electrically coupled to said further first transducer element;

said first transducer element being electrically coupled in series with said further second transducer element and said second transducer element being electrically coupled in series with said further first transducer element.

2. The apparatus recited in claim 1, wherein said first transducer element effectively produces a greater sound pressure signal than said further first transducer element and said second transducer element effectively produces a greater sound pressure signal than said further second transducer element, when said electrical signals on said first and second channels are substantially of equal magnitude.

3. The apparatus recited in claim 2, wherein said transducer elements produce sound pressure signals such that the sound pressure signal from the further first transducer element is effectively acoustically subtracted from the sound pressure signal from the first transducer element and the sound pressure signal from the further second transducer element is effectively acoustically subtracted from the second pressure signal from the second transducer element.

4. The apparatus recited in claim 1, wherein a ratio of turns of said first voice coil to said further first voice coil is a number greater than one and a ratio of turns of said second voice coil to said further second voice coil is a number greater than one.

5. The apparatus recited in claim 1, wherein the number is the same for both ratios.

6. The apparatus recited in claim 2, further comprising a filter adapted to curtail a frequency range over which cross coupling occurs coupled to each of said first and second transducers.

7. The apparatus recited in claim 6, wherein the filter comprising a filter in series with said first transducer element and a filter in series with said second transducer element.

8. The apparatus recited in claim 7, wherein each of said filters comprise a low pass filter.

9. The apparatus recited in claim 2, further comprising means for switching between a cross coupling mode and a mode in which cross coupling does not occur.

10. The apparatus recited in claim 9, wherein said switching means comprises a first switch for disconnecting said first transducer element from said further second transducer element and for connecting substantially only said first transducer element to said first channel and a second switch for disconnecting said second transducer element from said further first transducer element and for connecting substantially only said second transducer element to said second channel.

11. The apparatus recited in claim 10, further comprising resistor means coupled to said switching means for equalizing sound levels between the cross coupling mode and the mode in which cross coupling does not occur.

12. Apparatus for providing cross coupling of information on two channels in a two channel transducer, the two channel transducer being a stereo headphone, the apparatus comprising:

a first housing having a first transducer adapted to convert an electrical signal on a first of said channels to sound; and a second housing having a second transducer adapted to convert an electrical signal on a second of said channels to sound;

said first transducer comprising a first transducer element and said first housing having a further first transducer element, and second transducer comprising a second transducer element and said second housing having a further second transducer element, said first transducer element being electrically coupled to said further second transducer element and said second transducer element being electrically said further first transducer element;

said first transducer element effectively producing a greater sound pressure signal than said further first transducer element and said second transducer element effectively producing a greater sound pressure signal that said further second transducer element, when said electrical signals on said first and second channels are substantially of equal magnitude;

said transducer elements producing sound pressure signals such that the sound pressure signal from the further first transducer element is effectively acoustically subtracted from the sound pressure signal from the first transducer element and the sound pressure signal from the further second transducer element is effectively acoustically subtracted from the sound pressure signal from the second transducer element;

said first transducer element being electrically coupled in series with said further second transducer element and said second transducer element being electrically coupled in series with said further first transducer element.

13. Apparatus for providing cross coupling of information on two channels in a two channel transducer, the two channel transducer being a stereo headphone, the apparatus comprising:

a first housing having a first transducer adapted to convert an electrical signal on a first of said channels to sound; and a second housing having a second transducer adapted to convert an electrical signal on a second of said channels to sound;

said first transducer including a first voice coil and said first housing having a further first voice coil, said second transducer including a second voice coil and said second housing having a further second voice coil, said first voice coil being electrically coupled to said further second voice coil and said second voice coil being electrically coupled to said further first voice coil;

said first voice coil effectively producing a greater sound pressure signal than said further first voice coil and said second voice coil effectively producing a greater sound pressure signal than said further second voice coil, when said electrical signals on said first and second channels are substantially of equal magnitude;

said voice coils producing sound pressure signals such that the sound pressure signal from the further first voice coil is effectively acoustically subtracted from the sound pressure signal from the first voice coil and the sound pressure signal from the further second voice coil is effectively acoustically subtracted from the sound pressure signal from the second voice coil;

said first voice coil being electrically coupled in series with said further second voice coil and said second voice coil being electrically coupled in series with said further first voice coil.

14. A method for cross coupling information on two channels in a two channel transducer, the two channel transducer being a stereo headphone, the method comprising:

providing a first sound transducer in a first housing and electrically coupled a first electrical signal on a first of said channels to said first sound transducer;

providing a second sound transducer in a second housing and electrically coupling a second electrical signal on a second of said channels to said second sound transducer;

providing a further first sound transducer in said first housing and electrically coupled said second electrical signal on said second channel to said further first sound transducer;

providing a further second sound transducer in said second housing and electrically coupled said first electrical signal on said first channel to said further second sound transducer;

providing said second electrical signal to said further first sound transducer in said first housing whereby said first sound transducer effectively produces a greater sound pressure signal that said further first sound transducer;

providing said first electrical signal to said further second sound transducer in said second housing whereby said second sound transducer effectively produces a greater sound pressure signal than said further second sound transducer;

effectively acoustically subtracting the sound pressure signal from said further first transducer from the second pressure signal from the first transducer and effectively acoustically subtracting the sound pressure signal from said further second transducer from the sound pressure signal from the second transducer;

electrically coupled said first and said further second transducers in series; and electrically coupled said second and said further first transducers in series.

15. A method for cross coupling information on two channels in a two channel transducer, the two channel transducer being a stereo headphone, the method comprising:

providing a first sound transducer in a first housing and electrically coupling a first electrical signal on a first of said channels to said first sound transducer;

providing a second sound transducer in a second housing and electrically coupling a second electrical signal on a second of said channels to said second sound transducer;

providing a further first sound transducer in said first housing and electrically coupling said second electrical signal on said second channel to said further first sound transducer;

providing a further second sound transducer in said second housing and electrically coupled said first electrical signal on said first channel to said further second sound transducer;

electrically coupling said first and said further second transducers in series; and electrically coupling said second and said further first transducers in series.

16. The method recited in claim 15 wherein the third step of providing comprises providing said second electrical signal to said further first sound transducer in said first housing so that said first sound transducer effectively produces a greater sound pressure signal that said further first sound transducer and the fourth step of providing comprises providing said first electrical signal to said further second sound transducer in said second housing so that said second sound transducer effectively produces a greater sound pressure signal than said further second sound transducer.

17. The method recited in claim 16 wherein the third step of providing further comprising effectively acoustically subtracting the sound pressure signal from said further first transducer from the sound pressure signal from said first transducer and the fourth step of providing comprises effectively acoustically subtracting the sound pressure signal from said further second transducer from the sound pressure signal from said second transducer.

18. The method recited in claim 16, further comprising filtering the information on the two channels to a frequency range over which cross coupling occurs.

19. The method recited in claim 18, wherein the step of filtering comprises providing a filter in series with said first transducer and providing a filter in series with said second transducer.

20. The method recited in claim 19, wherein said step of providing a filter comprises providing a low pass filter.

21. The method recited in claim 16, further comprising switching between a cross coupling mode and a mode in which cross coupling does not occur.

22. The method recited in claim 21, wherein said steps of switching comprises disconnecting said first transducer from said further second transducer and connecting substantially only said first transducer to said first channel and disconnecting said second transducer from said further first transducer and connecting substantially only said second transducer to said second channel.

23. The method recited in claim 21, further comprising switching a resistor means such that sound levels in said cross coupling mode and the mode in which cross coupling does not recur are equalized.

24. The method recited in claim 15, further comprising:

providing said first and said further first transducers with a relative turns ratio of the first to the further first transducer greater than one; and providing said second and said further second transducers with a relative turns ratio of the second to the further second transducer greater than one.

25. The method recited in claim 15, wherein the two turns ratios are the same.

* * * * *